US008723727B2

(12) United States Patent
Albrecht

(10) Patent No.: US 8,723,727 B2
(45) Date of Patent: May 13, 2014

(54) SLOT ANTENNA AND RFID METHOD

(75) Inventor: Stefan Albrecht, Mauchenheim (DE)

(73) Assignee: Pepperl + Fuchs GmbH, Mannheim (DE)

( * ) Notice: Subject to any disclaimer, the term of this patent is extended or adjusted under 35 U.S.C. 154(b) by 0 days.

(21) Appl. No.: 13/197,914

(22) Filed: Aug. 4, 2011

(65) Prior Publication Data

US 2011/0316746 A1 Dec. 29, 2011

Related U.S. Application Data

(63) Continuation of application No. 12/446,814, filed as application No. PCT/EP2007/006582 on Jul. 24, 2007, now Pat. No. 7,999,736.

(51) Int. Cl.
*H01Q 3/00* (2006.01)

(52) U.S. Cl.
USPC ..... 342/372

(58) Field of Classification Search
USPC ..... 342/372
See application file for complete search history.

(56) References Cited

U.S. PATENT DOCUMENTS

| | | | | |
|---|---|---|---|---|
| 3,340,534 | A | 9/1967 | Fee | |
| 5,347,287 | A | 9/1994 | Speciale | |
| 5,596,336 | A | 1/1997 | Liu | |
| 5,861,839 | A * | 1/1999 | Upton et al. | 342/350 |
| 5,940,041 | A | 8/1999 | Koyama et al. | |
| 5,955,998 | A | 9/1999 | Roberts et al. | |
| 6,972,727 | B1 * | 12/2005 | West et al. | 343/771 |
| 8,081,063 | B2 * | 12/2011 | Maguire | 340/10.2 |
| 2002/0044098 | A1 | 4/2002 | Von Stein et al. | |
| 2004/0201533 | A1 | 10/2004 | Sievenpiper et al. | |
| 2006/0109130 | A1 * | 5/2006 | Hattick et al. | 340/572.7 |
| 2006/0125638 | A1 * | 6/2006 | Marino | 340/572.7 |

FOREIGN PATENT DOCUMENTS

| | | | |
|---|---|---|---|
| CN | 101755366 | A | 6/2010 |
| EP | 0149922 | A2 | 7/1985 |
| EP | 0669672 | A1 | 8/1995 |
| EP | 1158606 | A1 | 11/2001 |
| EP | 1602148 | A1 | 12/2005 |
| EP | 2047565 | A1 | 4/2009 |
| JP | 56119312 | | 9/1981 |
| JP | 02052508 | | 2/1990 |
| JP | 02090703 | | 3/1990 |
| JP | 09008547 | | 1/1997 |
| JP | 10224143 | | 8/1998 |

(Continued)

OTHER PUBLICATIONS

PCT International Search Report, International Application No. PCT/EP2007/006582, pp. 1-3, Date of Mailing International Search Report Apr. 25, 2008.

(Continued)

*Primary Examiner* — Harry Liu
(74) *Attorney, Agent, or Firm* — Hoffman Warnick LLC

(57) ABSTRACT

The invention relates to a slot antenna, more particularly to a transmitting antenna for RFID, comprising an antenna contour board having a plurality of antenna slots and at least one control circuit for enabling the antenna contour board to transmit and/or receive electromagnetic radiation. The slot antenna is characterized in that in at least one antenna slot of the antenna contour board there is inserted a circuit board carrying a control circuit. The invention further relates to an RFID method involving the use of the slot antenna of the invention.

15 Claims, 2 Drawing Sheets

(56) References Cited

FOREIGN PATENT DOCUMENTS

| | | | |
|---|---|---|---|
| JP | 2002118420 | A | 4/2002 |
| JP | 2003046326 | A | 2/2003 |
| JP | 2004048763 | A | 2/2004 |
| JP | 2007180800 | A | 7/2007 |
| JP | 2007181173 | A | 7/2007 |
| JP | 2010534435 | A | 11/2010 |
| RU | 49319 | U1 | 11/2005 |
| RU | 2295809 | C2 | 3/2007 |
| RU | 2236021 | C1 | 9/2009 |
| WO | 2004062035 | A1 | 7/2004 |
| WO | 2009012796 | A1 | 1/2009 |

OTHER PUBLICATIONS

Tanaka et al., "Circularly Polarized Printed Antenna Combining Slots and Patch", XP-001541881, IECE Transactions on Communications, vol. E90-B, No. 3, pp. 621-629, Mar. 2007.
Harry K. Liu, PTO Office Action, U.S. Appl. No. 12/446,814, Notification Date Dec. 27, 2010, 10 pages.
Harry K. Liu, PTO Notice of Allowance and Fee(s) Due, U.S. Appl. No. 12/446,814, Date Mailed May 5, 2011, 5 pages.
Harry K. Liu, PTO Supplemental Notice of Allowability, U.S. Appl. No. 12/446,814, Notification Date May 27, 2011, 2 pages.

* cited by examiner

SLOT ANTENNA AND RFID METHOD

This patent application is a continuation application of U.S. patent application Ser. No. 12/446,814, filed on May 14, 2009, which will issue as U.S. Pat. No. 7,999,736 on Aug. 16, 2011, and which is incorporated herein in its entirety by reference.

The present invention relates, in a first aspect, to a slot antenna, more particularly to a transmitting antenna for RFID.

In a further aspect, the invention relates to an RFID method.

A slot antenna of the generic type comprises at least one antenna contour board having a plurality of antenna slots and at least one control circuit for stimulating the antenna contour board to transmit and/or receive electromagnetic radiation.

The technology for remote identification of objects and persons via radio waves (Radio Frequency Identification, RFID) is used in a number of different fields.

RFID technology is utilized, for example, in military applications, in identification cards, in libraries and, in particular, in the field of industrial manufacturing and automation.

The growing number of closely packed electrical and electronic devices gives increasing rise to problems in industrial environments. The problem to be solved in this case is, in general, to minimize or, if possible, to eliminate interactions between such devices. This particularly involves utilizing all available frequency bands, for example by using shorter wavelengths.

The use of slot antennas for short wavelengths is already known. For example, slot antennas have been disclosed in the documents WO 2004/062035, EP 1 602 148, EP 1 158 606, and U.S. Pat. No. 5,596,336.

The ever-increasing complexity of manufacturing processes, for example 3D-manufacturing, gives rise to problems. Furthermore, new process steps, including the RFID method, are introduced during final inspections, for example.

The various interferences and influences on RFID systems, caused, for example, by microwave heaters, Bluetooth devices, or WLAN computer networks, can therefore cause an unwanted break in communication between the reading device or "reader" and the data carrier. This is of particular significance, since the number of interference sources is in future likely to increase, rather than decrease.

The desired housing dimensions drastically reduce the number of antennas that can be integrated therein. When, nevertheless, a minimum sensitivity as in known systems is required, the gain produced by the antennas must remain the same, which would seem to be unachievable when using antennas known hitherto.

Other antenna types, other than slot antennas, are either not known or are unsuitable on account of their high space requirements.

It is an object of the invention to provide a slot antenna, particularly for RFID applications, which is suitable for diverse applications and is, moreover, constructed in a particularly compact manner. Furthermore, an RFID method is to be provided, by means of which increased functionality is to be achieved.

Preferred exemplary embodiments of the slot antenna of the invention and preferred variants of the method of the invention are the subject-matter of the dependent claims.

The slot antenna of the type mentioned above is developed, according to the invention, in that in at least one antenna slot, particularly from a reverse side of the antenna contour board, there is inserted a circuit board carrying a control circuit.

In the method of the invention, a slot antenna of the invention is used and an emitting direction of the radiation is altered in a desired manner by varying the phase relationship of the control circuits.

The control circuit can comprise components of a feed system for coupling in the required control power or feed power. For example, a feed network having suitable drivers and matching circuits can be part of the drive circuit. If the slot antenna is also used for receiving electromagnetic radiation, the drive circuit can include a reception circuit or parts thereof.

The central concept of the invention may be considered to be the use of existing antenna slots for mechanical accommodation or support of circuit boards on which the necessary control circuits for the antenna are disposed.

A first substantial advantage of the invention is the realization of a particularly compact and thus space-saving arrangement.

Another substantial advantage of the invention is that the dielectric properties of the circuit board material reduce, in effect, the size of the antenna slots and thus shorten the wavelength.

The central concept of the method of the invention may be considered to reside in selective alteration of the direction of radiation of the transmitter or the reading device, unlike in known RFID methods, but rather by varying the phase differences between the individual control circuits.

In advantageous variants of the antenna of the invention, a plurality of antenna slots disposed in pairs is provided in the antenna contour board. It is particularly preferable if two pairs of slots are provided which are disposed mutually transversely, more particularly orthogonally on each other, since the polarization of the radiation can then be selectively varied by suitably controlling the slots. With a suitable phase relationship of the respective controlling or driving of the slots, such an antenna can also emit circularly polarized radiation, as a result of which the functionality of the antenna of the invention and that of the method of the invention is increased considerably.

However, already a simple slot antenna having two collinear slots might suffice, basically. Such an antenna emits so-called magnetic dipole radiation when suitably controlled.

Exemplary embodiments in which a plurality of pairs of antenna slots is disposed in the antenna contour board are preferred. For example, the antenna contour board may comprise a rectangular array of four antenna slots or a cross-wise array of, again, four antenna slots.

In a particularly preferred variant, a cross-wise array of, again, four antenna slots is disposed within a rectangular array of four antenna slots. Here, the antenna slots can be considered as being interested. There, the orientation of the antenna slots disposed in a cross-wise array can advantageously be such that the antenna slots are located substantially on the diagonals of the rectangular array. This slot arrangement provides a particularly compact construction.

The control circuits each advantageously comprise electronic phase shifters for defined adjustment of the phase relationship of a control signal.

The aforementioned particularly preferred antenna arrangement having a rectangular array of antenna slots and a cross-wise array of antenna slots disposed within the former thus consists of a plurality of slot radiators, each of which is controlled by means of an electronically adjustable phase shifter. The individual antenna slots are fed or driven by means of a circuit board that is disposed orthogonally or transversely thereto. This circuit board includes the feed zone of the slot radiator, a matching network, the phase shifter, filters, a polarization-switching device, and a suitable control interface. This exemplary embodiment is characterized by very good functionality, since a redundancy of the system is achieved by the antenna slots disposed in mutual angular misalignment. This means that even in the case of functional losses of individual radiator elements, no total breakdown occurs, and such functional losses can in any case be partially compensated by suitable compensating means.

Basically, the necessary control power can be coupled by radiation into the antenna contour board by the control circuits. With regard to space requirements, however, the circuit boards are preferably galvanically coupled, i.e., in the simplest case, conductively connected, to the antenna contour board in a region surrounding the respective antenna slot.

In principle, individual antenna slots can remain free if no circuit board can be accommodated therein, possibly for reasons of space or because electrically undesirable. However, the construction is simplified if a circuit board carrying a control circuit is inserted in each antenna slot.

A further simplification is achieved when in each case identical circuit boards are placed in all of the antenna slots. The use of in each case identical circuit boards carrying identical control circuits can save material to a large extent. Furthermore, considerable advantages are gained with regard to storage, and significant cost savings are possible.

Basically, the influence of the dielectric properties of the circuit board material on the antenna radiation is particularly high if the antenna slots are substantially fully occupied by the circuit board. For example, the circuit board can have a tongue, which fits exactly in the respective antenna slot.

Furthermore, the higher the relative dielectric constant of the circuit board material, the greater is the effect mentioned above. Therefore, special dielectric materials can, in principle, be used, in order to achieve the desired degree of miniaturization. The relatively high costs set limits to the use of such materials.

The construction provided by the invention, in which the circuit boards are pushed into the antenna slots, is therefore particularly economical, since the substrate is efficiently concentrated mainly in the slot region.

The influence of the dielectric properties of the circuit board material can be increased if at least one circuit board projects slightly beyond a transmitting side of the antenna contour board. Finally, the effect of the inserted circuit boards can be increased still further if protruding parts of the circuit boards are provided with a metallic structurization. For example, it is particularly easy to produce a metallic structurization formed by conductor track portions extending transversely to the antenna contour board on the protruding parts of the circuit boards.

The circuit boards advantageously comprise means for contacting the slot radiator in the region of the antenna slot.

In this context, it may be considered a further important aspect of the slot antenna of the invention that the point at which the feed power or control power is coupled into the antenna contour board is defined very accurately. This represents a considerable advantage over slot antennas disclosed in the prior art, in which coaxial cables are solder-attached, for example. For example, contact between the antenna contour board and the circuit board can be achieved by means of a conductor track region on the circuit board, which conductor track region narrows toward the antenna contour board. The location of the actual contact region is then defined very precisely.

Energization of the slot can thus take place precisely and, in particular, reproducibly. This represents a considerable advantage with regard to the requirements for series production. There is complete freedom in the choice of the feed points and thus an additional degree of freedom is provided that can be selectively used and varied.

In a further preferred embodiment of the antenna of the invention, the circuit boards are inserted in a stabilizing board on a side opposite the antenna contour board. This stabilizing board can itself be a circuit board and can carry additional electronic or electrical components.

Additional advantages and features of the slot antenna of the invention and the method of the invention are described below with reference to the attached schematic figures, in which.

Figure 1:
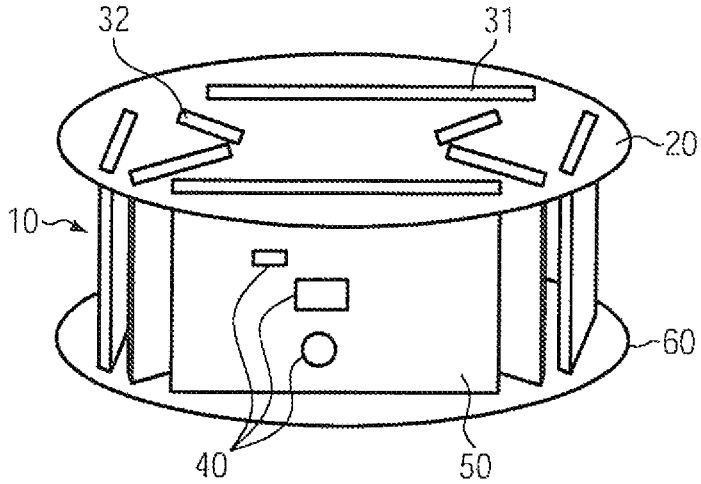
FIG. 1 shows an exemplary embodiment of a slot antenna of the invention.

An exemplary embodiment of the antenna 10 of the invention is described with reference to FIGS. 1 to 3. Like components are provided with like reference numerals.

As its essential components, the antenna 10 of the invention comprises an antenna contour board 20, a plurality of circuit boards 50 with control circuits 40 disposed thereon and a stabilizing board 60, which can likewise carry electronic components.

Figure 2:
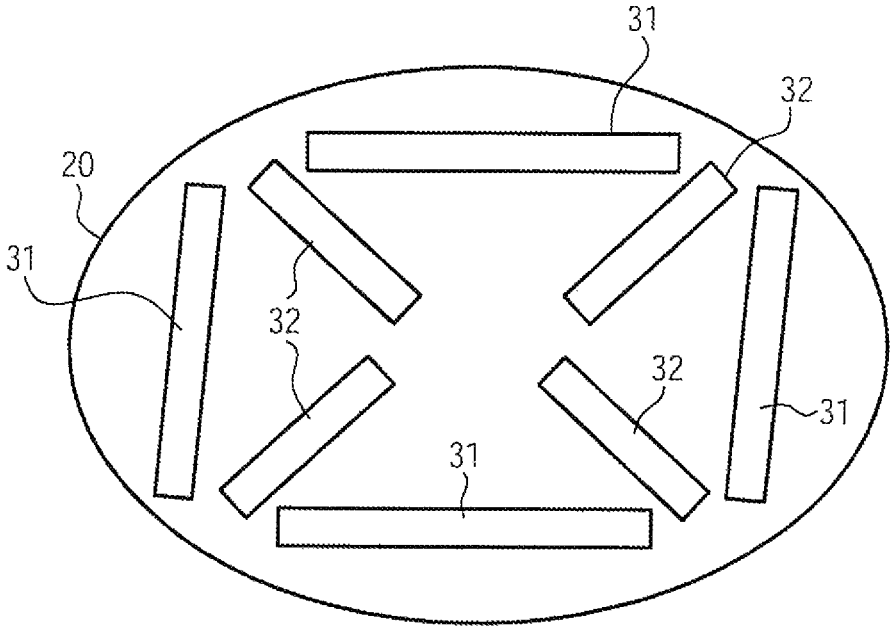
FIG. 2 is a plan view of the antenna contour board of the antenna shown in FIG. 1.

The antenna contour board 20 shown in FIG. 2 comprises two antenna systems located orthogonally to each other. The first antenna system comprises a rectangular array of four antenna slots 31 and the second slot system comprises four antenna slots 32 disposed in a cross-wise arrangement. The antenna slots 32 disposed in a cross-wise arrangement are located within the rectangle formed by the antenna slots 31 and are aligned substantially on the diagonals of the latter.

The slot systems are thus internested and consequently require less space. The problem of controlling or feeding the antenna slots is solved, according to the invention, by the insertion of the circuit boards 50 into the antenna slots 31, 32.

Figure 3:
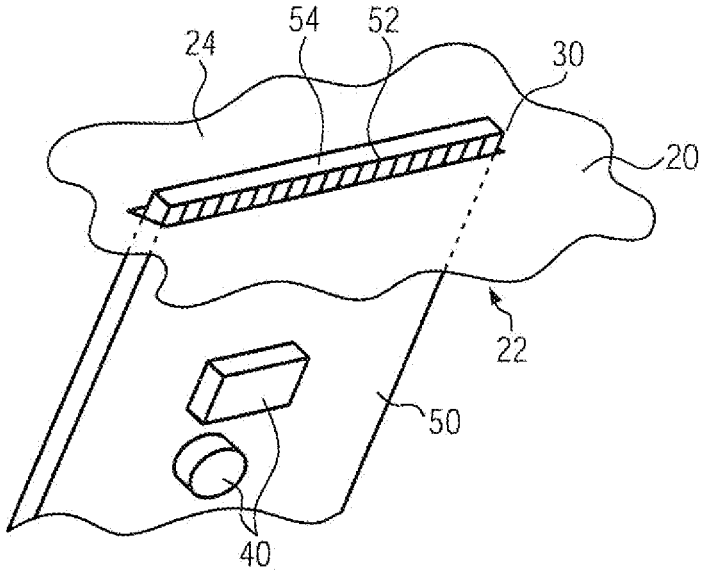
FIG. 3 is a partial view of the antenna shown in FIG. 1.

As shown in FIG. 3, a circuit board 50 inserted into the antenna contour board 20 from a reverse side 22 can also protrude slightly on a transmitting side 24 of the antenna contour board 20. This intensifies the effect of the dielectric properties of the circuit board material.

Furthermore, a protruding part 54 of the circuit board 50, as likewise shown schematically in FIG. 3, can be provided with a metallic structurization 52, which produces a field concentration in the antenna slot 30 and thus makes a miniaturization possible. In the example shown in FIG. 3, the metallic structurization 52 comprises conductor track portions extending transversely to the antenna contour board 20.

A number of advantages are achieved by the construction shown in FIG. 1. For example, also antenna slots 31, 32 located extremely close to each other by way of the construction technology shown in detail in FIG. 3 can be controlled by means of the control boards 50, which also carry the electronic circuits 40.

All antenna slots 31, 32 preferably have identical dimensions so that in each case uniform feed networks or, more generally, standard circuit boards 50 carrying control circuits 40 can be used.

If materials having enhanced values of the relative dielectric constant are used as the base material for the circuit boards 50, this contributes to stronger field concentrations in the slots and thus to the miniaturization. The slot length can be reduced in this way.

At the same time, this makes it possible to reduce the dimensions of the circuit boards 50 carrying the control circuits 40. On the side opposite to the antenna contour board 20, a stabilizing board 60 is mounted, which can likewise be a circuit board carrying additional electric and/or electronic components.

The construction shown in FIG. 1 with the back stabilizing board 60 is as a whole characterized by an excellent mechanical stability and an extremely compact design. The circuit boards 50 carrying control circuits 40 disposed transversely on the boards or punched parts can accommodate passive and active components.

At the same time, these control circuits 40 serve to feed and connect the antennas via galvanic coupling, i.e., in the simplest case, via a simple conductive connection. This requires less space compared with radiation coupled slot antennas.

It is moreover particularly advantageous if the control circuits 40 each comprise electronic phase shifters, since the beam lobe and/or the directional characteristic of the antenna can be varied selectively according to the method of the invention.

Figure 4:
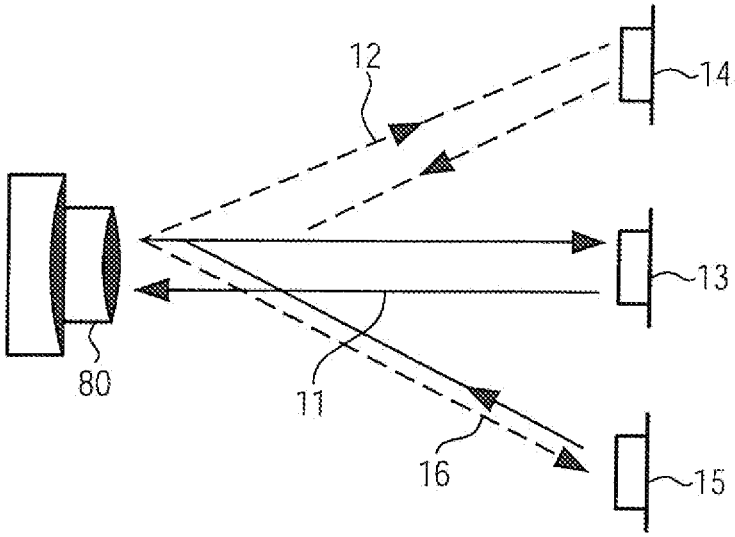
FIG. 4 illustrates the method of the invention.

This is explained in more detail with reference to FIG. 4. There an RFID reader 80 comprising a slot antenna of the invention of the type shown in FIG. 3 is illustrated. Individual RFID tags at different sites are indicated by the reference numerals 13, 14 and 15. Tag 13 is addressed by the beam emitted in the normal direction and indicated by the reference numeral 11, whereas tags 14 and 15 are addressed by the beams deflected in directions 12 and 16. The directional characteristic of the antenna of the invention is varied by selective adjustment of the phase shifter in the control circuits 40 of the respective antenna slots 31, 32.

This allows for new applications. For example, an individual tag can be tracked with the aid of the antenna of the invention. Furthermore, individual tags can be addressed and read selectively. Localization by simultaneous use of a plurality of readers is possible. Due to the well-defined directional characteristic of the antenna, specific solid angle regions can be suppressed selectively. This serves to achieve the interference suppression described above.

A plurality of readers can be networked to form a complex overall system and readers having high sharpness of directivity and range can be realized. These then have increased localizing resolution during the positioning due to a virtually larger aperture. Both short-range and long-range detection can thus be realized.

A miniaturizable slot antenna system is thus provided by the present invention, more particularly for use in RFID readers. Such readers operate preferably in the microwave range, for example, at 2.5 GHz.

A significant concept of the method of the invention consists in the selective control of the directional characteristic of the antenna. The use of the slot antennas of the invention provides a high-capacity and compact antenna system, which moreover allows for reduction in costs and is particularly advantageous as regards construction and connecting technology. The term "compactness" of the antenna implies, in particular, the reduced dimensions thereof. A considerable advantage can thus be achieved over the systems available on the market, which are distinctly larger than the slot antennas presently described. The density of the readers can be increased by the possibility of beam deflection—an electrically variable directional characteristic of the antenna construction—without any mutual interference occurring between the readers.

As a result, potential interference factors such as microwave heaters, for example, can likewise be suppressed. Furthermore, physical impairments due to the direct environment and the prevailing conditions in each case can be compensated. Another result derived therefrom is the possibility of tracking a data carrier.

Advantageously, the zero points inevitably occurring in radio propagation due to standing waves can be eliminated by means of a change of frequency or "frequency hopping" and/or by deflection of the beam. To regulate the range, the emitted transmitter power can advantageously be regulated and, likewise, the sensitivity can be varied by means of low-noise preamplifiers.

So-called "phased-array antennas" can therefore be realized in an advantageous manner using the slot antenna of the invention. The use of such antennas of the invention makes it possible to achieve extremely quick deflection of the beam and furthermore to provide for very flexible adjustment of the directional characteristics of the antenna.

The invention can also be used to provide identification at building entrances, in addition to applications involving reading systems, data carriers, general radio communication, radar sensors, and localizing systems.

The present invention thus provides an overall compact intelligent antenna system with the possibility of switching the polarization and effecting beam deflection.

The invention claimed is:

1. A phased slot antenna array, comprising:

an antenna contour board having a plurality of antenna slots; and at least one control circuit for stimulating the antenna contour board to at least one of transmit and receive electromagnetic radiation;

wherein in at least one antenna slot of the antenna contour board there is inserted a circuit board carrying a control circuit;

wherein by varying the phase relationship of the individual control circuits an emitting direction of the radiation is selectively altered; and wherein zero points occurring due to standing waves are eliminated by at least one of a change of frequency, frequency hopping, and deflection of the beam.

2. The slot antenna as defined in claim 1, wherein the antenna contour board includes a rectangular array of four antenna slots.

3. The slot antenna as defined in claim 1, wherein the antenna contour board includes a cross-wise array of four antenna slots.

4. The slot antenna as defined in claim 2, wherein the cross-wise array of antenna slots is nested within the rectangular array of antenna slots.

5. The slot antenna as defined in claim 1, wherein a circuit board carrying a control circuit is inserted in each antenna slot.

6. The slot antenna as defined in claim 1, wherein identical circuit boards are inserted in all of the antenna slots.

7. The slot antenna as defined in claim 1, wherein the circuit boards are galvanically connected to the antenna contour board in a region surrounding the respective antenna slot.

8. The slot antenna as defined in claim 1,
wherein
at least one circuit board projects slightly beyond the antenna contour board on its transmitting side.

9. The slot antenna as defined in claim 1,
wherein
the circuit board includes a protruding portion, and
wherein
the protruding portion of the circuit board is provided with a metallic structurization.

10. The slot antenna as defined in claim 9,
wherein
the metallic structurization is in the form of conductor track portions extending transversely to the antenna contour board on the protruding portion of the circuit boards.

11. The slot antenna as defined in claim 1,
wherein
the circuit boards are inserted in a stabilizing board opposite to the antenna contour board.

12. The slot antenna as defined in claim 1,
wherein
the antenna is designed as a transmitting antenna for RFID.

13. A method for the operation of a phased slot antenna array, comprising:
an antenna contour board having a plurality of antenna slots; and
a plurality of control circuits for stimulating the antenna contour board to at least one of transmit and receive electromagnetic radiation;
wherein
in at least one antenna slot of the antenna contour board there is inserted a circuit board carrying a control circuit;
wherein
by varying the phase relationship of the individual control circuits an emitting direction of the radiation is selectively altered; and
wherein
zero points occurring due to standing waves are eliminated by at least one of a change of frequency, frequency hopping, and deflection of the beam.

14. The method as defined in claim 13,
wherein
suitable selection of the phase relationship of the individual control circuits stimulates the slot antenna to radiate circularly polarized radiation.

15. The method as defined in claim 13,
wherein
the control circuits, in each case, comprise electronic phase shifters; and
at least one of the beam lobe and the directional characteristic of the antenna is selectively varied by the electronic phase shifters.

* * * * *